United States Patent [19]

Yannuzzi, Jr. et al.

[11] Patent Number: 4,976,674

[45] Date of Patent: Dec. 11, 1990

[54] BAG AND METHOD OF MAKING THE SAME

[75] Inventors: Gilbert N. Yannuzzi, Jr., Richboro, Pa.; Jeffrey D. Muhs, Sun Prairie, Wis.

[73] Assignee: American Packaging Corporation, Philadelphia, Pa.

[21] Appl. No.: 489,455

[22] Filed: Mar. 6, 1990

[51] Int. Cl.[5] ..... B31B 1/64; B31B 49/04

[52] U.S. Cl. ..... 493/195; 493/217; 493/243; 493/253; 493/208

[58] Field of Search ..... 493/193, 199, 200, 201, 493/218, 228, 231, 241, 242, 341, 355, 217, 220, 243, 253, 264, 265, 208, 197, 202; 383/115, 126

[56] References Cited

U.S. PATENT DOCUMENTS

| | | | |
|---|---|---|---|
| 2,496,796 | 2/1950 | Kardon | 493/217 |
| 2,846,928 | 8/1958 | Kardon et al. | 493/208 |
| 3,017,069 | 1/1962 | Kardon et al. | 383/115 |
| 3,342,402 | 11/1967 | Kardon | 383/126 |
| 4,490,131 | 12/1984 | Coleman et al. | 493/217 |

*Primary Examiner*—Frederick R. Schmidt
*Assistant Examiner*—John A. Marlott
*Attorney, Agent, or Firm*—Frank A. Follmer

[57] ABSTRACT

The bottom of a gusseted, square-bottom bag is sealed by applying a fin seal, a cross seal which intersects the fin seal, and a third seal at the intersection of the fin seal and the cross seal.

3 Claims, 2 Drawing Sheets

FIG. 5
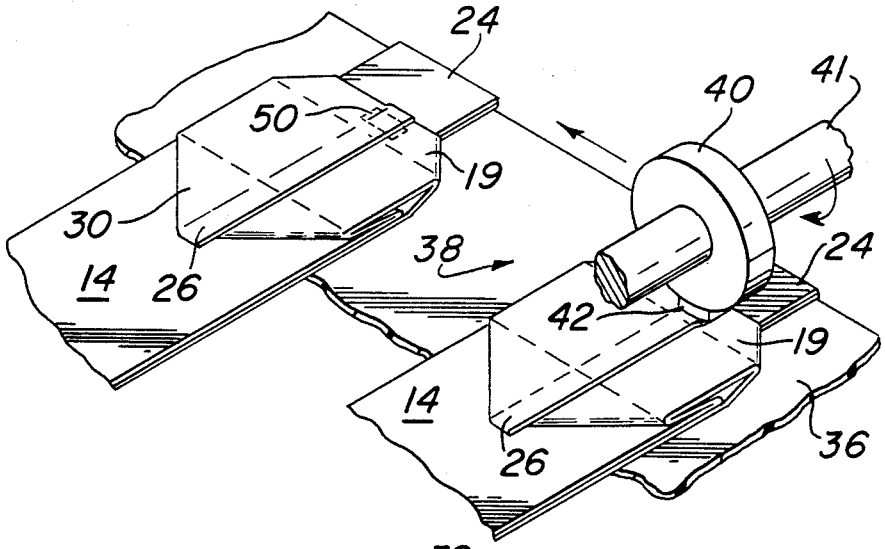
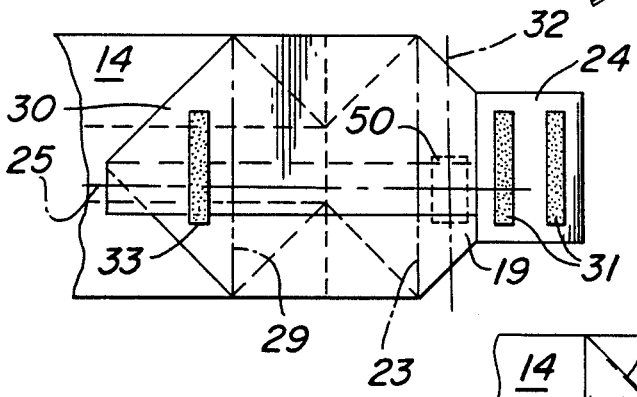
FIG. 6
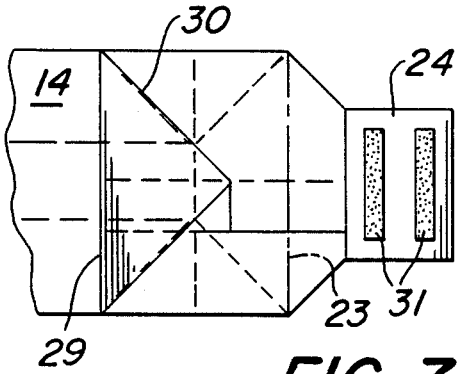
FIG. 7
PRIOR ART
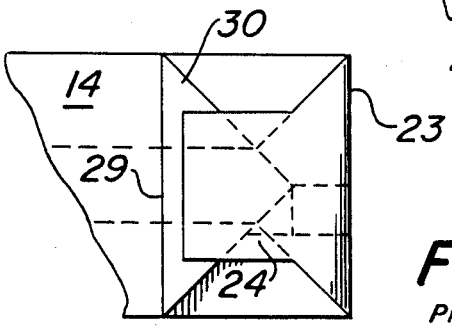
FIG. 8
PRIOR ART

BAG AND METHOD OF MAKING THE SAME

BACKGROUND AND SUMMARY OF THE INVENTION

This invention relates generally to bags of the gusseted, square-bottomed type and a method of making the same.

Gusseted, square-bottomed bags are disclosed in U.S. Pat. No. 2,496,796; 3,017,069 3,342,402; and 4,490,131. As disclosed in these patents, the bags of this type generally comprise an outer sheet of paper and an inner liner of an impervious heat sealable material such as a plastic (synthetic resin). The bag is made of a tube and the bottom end of the bag is formed by making a diamond fold comprising a triangular fold portion and a partly rectangular tab fold portion. After the triangular fold portion and the tab fold portion are sealed, the bottom of the bag is completed by folding over the tab fold portion onto a previously folded over triangular fold portion. The tab fold portion is caused to adhere to the bottom of the bag by applying suitable adhesive between the contiguous faces of the tab fold portion and the triangular portion of the bag bottom structure.

In accordance with the present invention there is provided a bag and a method of makingm, the same which provides an improved bottom construction which is very effectively sealed so that the bag can contain many materials, including liquids, without any seepage through the bag bottom. To this end, the bag is made by a method wherein a special seal is applied at a location at the intersection between the fin seal and the cross seal. This additional seal has been found to improve the sealing of the bag bottom structure such that the bag can be used in many applications which heretofore bags of the indicated type were unacceptable. For example, in the microwave cooking of food products, the bags are required to contain liquids, such as water, oil, etc., during storage and during the cooking processes wherein such liquids become very hot. In these applications, even the slightest pin hole or other opening in the seal of the bag bottom would cause a leakage or staining problem. Bags made by the method of the invention comprising the special seal at the intersection of the fin seal and cross seal have overcome these problems.

BRIEF DESCRIPTION OF THE DRAWINGS

FIG. 5 is a perspective view and FIG. 6 is a plan view showing the special sealing step in the method in accordance with the invention.

FIGS. 7 and 8 are plan views showing the final steps in the formation of the bag bottom.

DETAILED DESCRIPTION OF THE PREFERRED EMBODIMENT

Figure 1:
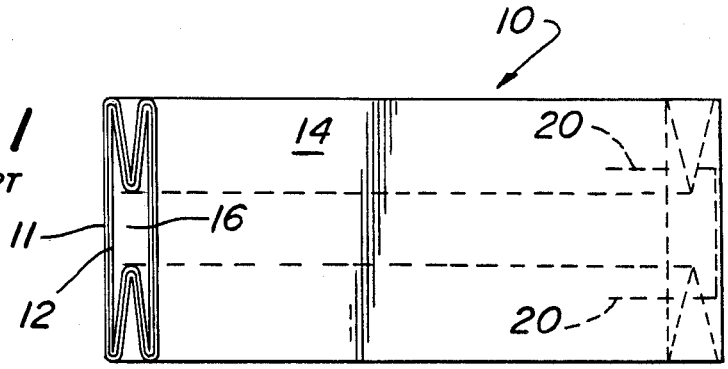
FIG. 1 PRIOR ART
FIGS. 1–4 are plan views showing successive steps in the method of making a bag in accordance with the invention.
Figure 2:
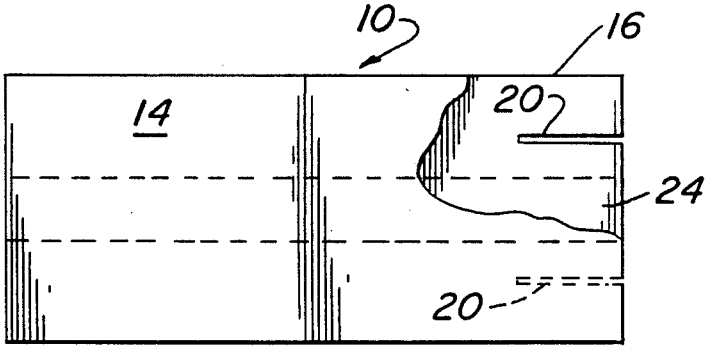
FIG. 2 PRIOR ART

The bag and the method of making the same in accordance with the invention is similar to that shown and described in U.S. Pat. No. 2,496,796, the essential difference being the manner in which the sealing of the bag bottom is performed. As described in said patent, the first step in the making of the bag is to form the tube, indicated at 10 in FIG. 1, and having an outer sheet 11 of paper and an inner liner 12 of an impervious, heat-sealable plastic (synthetic resin) whereby the bag may be sealed in the manner described in said patent. The tube forming step is performed on one of the automatic bag making machines well known in the art wherein the outer sheet 11 of the bag and the inner liner 12 are fed from rolls into overlapping relation and then folded together and cut into a tube 10 of the bellows-fold or gusseted type shown in FIG. 1 having front and back panels 14 and 16, respectively. During this tube forming procedure, the inner liner 12 is sealed onto the inner surface of the outer sheet 11 to provide an impervious bag construction.

As described in said patent, a pair of spaced-apart, parallel slits 20 are formed at the bottom of the panel 16 of tube 10. The slits 20 extend longitudinally from the bottom edge of the panel 16 of tube 10 and are spaced equidistantly from the longitudinal edges of this panel 16. The slits 20 extend through both the outer sheet 11 and the liner 12 and thus provide a double play rectangular-shaped tab portion 24.

Figure 3:
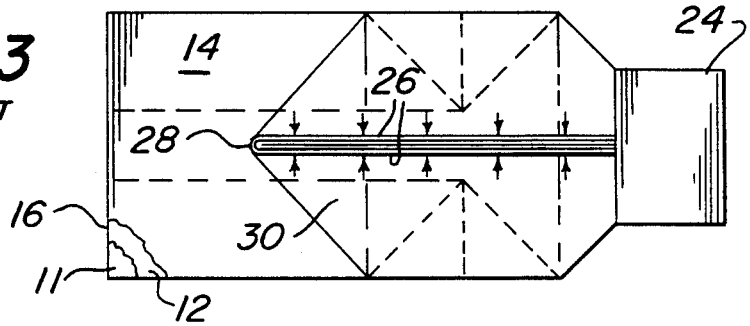
FIG. 3 PRIOR ART

The next step of the method is to form the bottom end of the tube 10 into a diamond fold as shown in FIG. 3 with the tab portion 24 located at one end and a triangular portion 30 at the other end, and providing upwardly extending flaps 26 at the center of the fold. The outer faces of flaps 26 are comprised of a portion of the outer sheet 11 which has a two-ply thickness of sealable liner 12 therebetween. Flaps 26 are united by a vertical fold 28 which is at the apex of the inner triangular portion 30 of the diamond fold. By this construction, there will be no opening in this area when the bottom of the bag is sealed as will be described hereafter.

While the bottom of the bag is being folded into the position shown in FIG. 3, a heat seal is applied along strips at right angles to flaps 26, as shown by the arrows in this figure. This is the first sealing step in the sealing of the bag bottom. The center line of this heat seal (known as the fin seal) is shown by dashed line 25 in FIG. 4. In this first sealing step, heat and pressure are applied in an amount necessary to cause the opposing faces of the portion of liner 12 within flaps 26 to adhere to each other and thereby seal the entire length thereof. U.S. Pat. No. 2,846,928 discloses a method of applying the fin seal in detail. The flaps 26 are then folded to the position shown in FIG. 4 and lie flush with the plane of the formed portion of the bag bottom.

Figure 4:
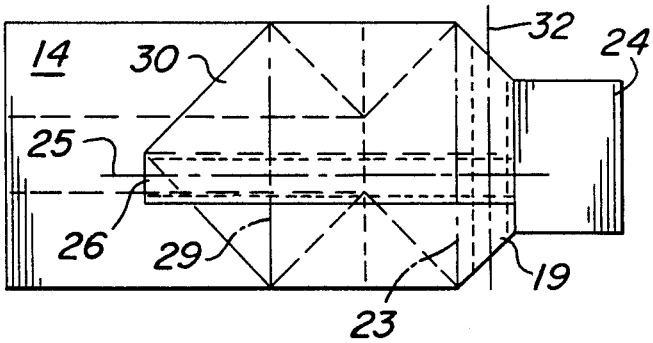
FIG. 4 PRIOR ART

With the bag in the condition shown in FIG. 4 of the Drawings, a heat seal is applied along a strip extending across the protruding tab portion 19 of the bag bottom. This is the second step in the sealing of the bag bottom. The centerline of this heat seal (known as the cross seal) is shown by dashed line 32 (FIG. 4), which intersects with centerline 25 of the fin seal and is located between the tab portion 24 and the fold or crease line 23 upon which the final fold of this part of the bottom portion will be made. In this second sealing step, heat and pressure are applied by a spring-biased pressure roll across a strip centered on line 25.

The next step in the bag making procedure is the novel feature of the invention, and is shown in detail in FIGS. 5 and 6. This step is the third sealing step in the sealing of the bag bottom. As the bag is moving along the conveyer 36 in the direction shown by the arrow in FIG. 5 from the station whereat the cross seal is applied, and while it is still relatively hot, it moves immediately into a third sealing station 38 whereat there is provided a pressure roll 40 which is constructed and arranged to put added pressure on the formed bag bottom as it moves along the conveyer 36, said pressure being applied at an area which is generally rectangular and centered on the intersection of the fin seal and the cross seal. This novel sealing step provides a very strong seal 50 over a large area and extends along both the fin seal and the cross seal and around the entire area at the intersection thereof as is best shown in FIGS. 5 and 6. To this end, roll 40 is mounted to rotate about its shaft 41 and is provided at its periphery with a radially extending projection or shoe portion 42 which applies pressure to the formed bag bottom over a rectangular area 50 as shown in FIGS. 5 and 6.

The next step in the bag making procedure is to apply deposits of glue or adhesive to the bottom portion of the tube 10 with the tube 10 in the flattened condition as shown in FIG. 6. The adhesive is applied along strip-like areas 31 of tab portion 24 and at an area 33 of triangular portion 30 as shown in FIG. 6.

In the final steps of the method, the triangular portion 30 of the diamond fold is bent over along the crease line 29, to the position shown in FIG. 7, after which the bottom portion with the tab portion 24 extending therefrom is folded over along crease line 23 onto the triangular portion 30 to complete the formation of the bag bottom as shown in FIG. 8. During this latter step, the rectangular tab portion 24 is pressed into contact on top of the triangular tab portion 30 so that the adhesive areas 31 and 33 provide attachment to contiguous areas of the bag bottom.

It will be apparent that a bag constructed as described above will have the bottom portion effectively closed and sealed, not only to prevent any sifting of finally powdered contents through the bottom, but also, to seal the bag bottom so that it could even contain liquids which are subjected to microwaving.

It is noted that the shoe portion 42 may be made with its bag contacting or imprinting area having either a smooth or a knurled surface.

What is claimed is:

1. A method of making a bag of the gusseted square-bottom type comprising the steps of:

forming a tube having an outer sheet and an inner liner of an imperivous material, with said liner being adhered to the outer sheet at the mating surfaces thereof, forming a pair of spaced-apart parallel slits in one of said tube walls extending inwardly from an edge to define a tab portion, forming the bottom end of the bag into a diamond fold with the tab portion at one end thereof and a triangular portion at the other end thereof, applying pressure seals to the diamond fold to completely seal the bottom end of the bag, said sealing step including a first sealing step wherein the diamond fold is heat and pressure sealed along the apex thereof to form a fin seal, a second sealing step wherein the diamond fold is heat and pressure sealed along an area adjacent said tab portion and extending transversely to said fin seal to form a cross seal intersecting with said fin seal, and a third sealing step wherein a pressure seal is applied across a substantial area at the intersection of said fin seal and said cross seal to provide a strong seal at this location to prevent leakage thereat, and completing the bag bottom by folding over the triangular portion and said tab portion and adhere the same together to complete the formation of the bottom of the bag.

2. A method according to claim 1 wherein said third sealing step is applied over a generally rectangular area generally centered at said intersection of said fin seal and said cross seal.

3. A method according to claim 2 wherein said third sealing step is performed immediately after said second sealing step.

* * * * *